United States Patent [19]

Nakano et al.

[11] Patent Number: 4,610,227

[45] Date of Patent: Sep. 9, 1986

[54] AUTOMATIC DECOMPRESSION SYSTEM FOR STARTING ENGINE

[75] Inventors: Keiichi Nakano; Tatsutoshi Umeda; Yoshio Tani, all of Osaka, Japan

[73] Assignee: Kubota Limited, Osaka, Japan

[21] Appl. No.: 691,764

[22] Filed: Jan. 16, 1985

[30] Foreign Application Priority Data

Jan. 20, 1984 [JP] Japan ..... 59-7098[U]
Apr. 20, 1984 [JP] Japan ..... 59-59214[U]

[51] Int. Cl.[4] ..... F01L 13/08
[52] U.S. Cl. ..... 123/182; 123/90.16
[58] Field of Search ..... 123/182, 90.16, 316

[56] References Cited

U.S. PATENT DOCUMENTS 3,620,203 11/1971 Harkness ..... 123/182
3,897,768 8/1975 Thiel ..... 123/182

*Primary Examiner*—Andrew M. Dolinar
*Attorney, Agent, or Firm*—Schwartz, Jeffery, Schwaab, Mack, Blumenthal & Evans

[57] ABSTRACT

The present invention relates to an automatic decompression system for starting an engine with a decompression pin penetrating the cam shaft to thrust a tappet of the valve moving system by biasing force of a spring for decompression and retreated from the tappet by centrifugal force of a fly weight and itself, wherein, said fly weight is inserted in the space between the inner periphery of the rim of the cam gear, which rim is extruded toward the cam, and the outer periphery of the flange faced against the outer periphery of the rim, which flange functions to decide the axial position of the cam gear.

4 Claims, 8 Drawing Figures

Fig. 1
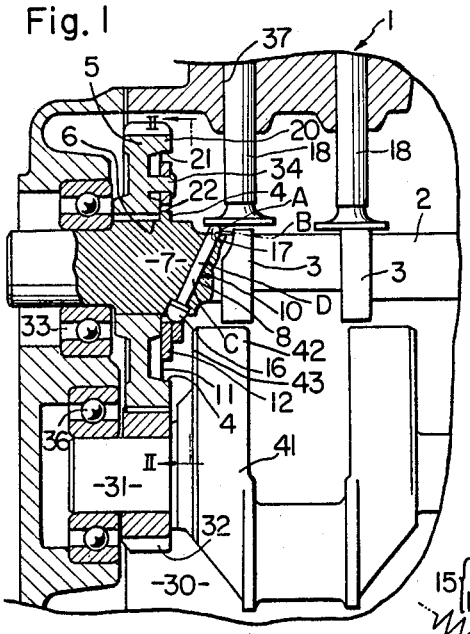
Fig. 2
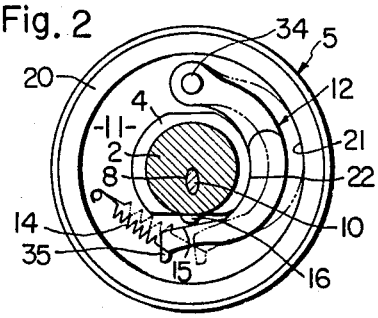
Fig. 3
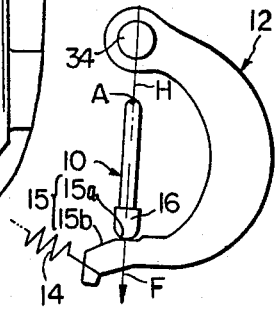
Fig. 4
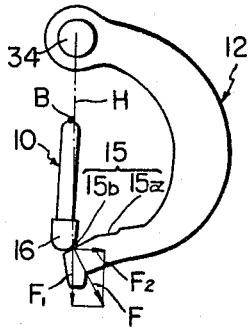
PRIOR ART
Fig. 5
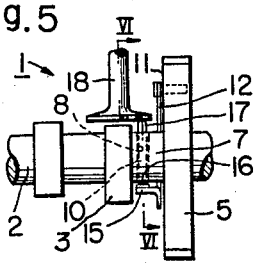
PRIOR ART
Fig. 6
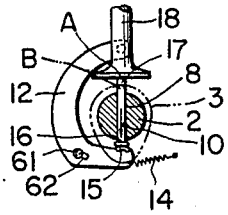
PRIOR ART Fig. 7
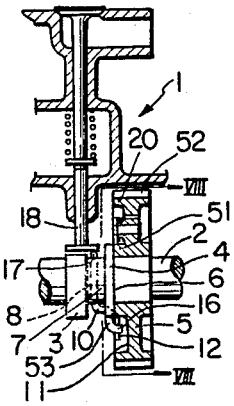
Fig. 8 PRIOR ART
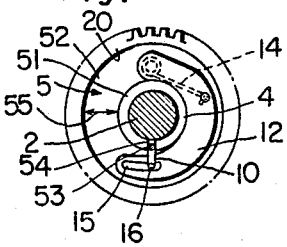

AUTOMATIC DECOMPRESSION SYSTEM FOR STARTING ENGINE

BACKGROUND OF THE INVENTION

1. Field of the Invention

The present invention relates to an automatic decompression system which functions to reduce the starting torque of the engine for starting it, and which is improved in the sensitivity, powerfullness of the decompression performance, in the smallness, and in the durability.

The present invention especially relates to such automatic decompression system which is provided with a common construction shown in FIGS. 1 to 8 of the attached drawings.

Namely, in the system, a cam shaft 2 of valve moving system 1 of the engine comprises a cam 3 and a flange 4 disposed thereon and properly separated from each other. And a cam gear 5 is fitted outwardly to the cam shaft 2 and contacted with the end surface 6 of the flange 4 at the contrary side to the cam 3. A guide hole 8 is provided to penetrate the shaft part 7 transversely between the cam 3 and the flange 4. A decompressing pin 10 is provided to pass reciprocatable through the guide hole 8. A fly weight 12 is pivoted on the cam gear 5 at the cam side surface 11, receiving the input part of the decompression pin 10 at the output part 15 thereof. The fly weight 12 is biased by a spring 14 to push the decompression spring 10 on the decompression position A at where the tappet 18 is pushed up by the tension of the spring 14, and the fly weight 12 is forced by the centrifugal force of itself to the cancelling position B at where the pin 10 is withdrawn from the tappet 18.

2. Related Art

As the first example, such system is found in the Japanese Patent Issue No. 46-39,892. As seen in FIGS. 7 and 8, the system described therein has a fly weight 12 which is located in an annular groove 52 formed between the rim 20 and the boss 51 of the cam gear. The outward motion of the fly weight 12 is stopped by the inner periphery of the rim 20, and the inward motion by the outer periphery of the boss 51. The output part 15 of the fly weight 5 presents a slit form and the input end part 16 of the decompression pin 10 is folded three times in right angle every time to fit in the output groove 15 of the fly weight 12. The klanking part 53 of the end part 16 near the output part 15 is inserted in a guide groove 54 formed radially in the flange 4.

In this known structure, the fly weight 12 is arranged within the annular groove 52 of the cam gear 5, so that it is advantageous to arrange smaller in the length along the cam shaft 2 by minimizing the space between the cam 3 and the cam gear 5.

However, the width 55 of the annuler groove 52 and the amplitude of the fly weight 12 is limited so small that the lifting angle (tangential inclination angle of the flank) necessary for lifting up the decompression pin 10 to carry out the decompression function must become stern and that the frictional resistance between the fly weight 12 and the pin 10 must become heavy. Moreover, the finishing accuracy can not be sufficiently high, since the output groove 15 is formed by internal machining, and the frictional resistance would become heavier by the roughness of the finishing. Furthermore, the decompression pin 10 receives heavy frictional resistance by the hard contact with the surface of the guide groove 54 formed in the flange 4, for the pin 10 is tending to turn about the guide hole 8 when it is driven by the fly weight 12.

Thus, the transmission efficiency between the fly weight 12 and the decompression pin 10 is low, the power to drive the decompression pin 10 is weak, and the sensitivity for cancelling the decompression function is insensible for the heavy frictional resistance of three kind abovementioned. Moreover, the fly weight 12 and the decompression pin 10 are easily defaced at their contacting faces by the heavy friction between them.

The second example is found in the Japanese Utility Model Issue No. 51-41,973. This example is comprised as described below and as shown in FIGS. 5 and 6.

Namely, the fly weight 12 is located outside of the cam gear 5, and the output part 15 is formed in extruding arc with a small curvature radius. The territory of swinging motion of the fly weight 12 is limited by a gap defined by the stopper pin 61 within a slit 62. The stopper pin 61 is fixed to the cam gear 5, and the slit 62 is cut through the fly weight 12.

In this structure, more accurate finishing accuracy is available and the frictional resistances may be decreased for that the finishing of the output part 15 of the fly weight 12, which presents an extruding curvilinear surface, may be machined by external machining. And it is advantageous in decreasing the heavy friction of decompression pin 10 with the guide groove 54 of the previous example.

However, in this system the curvature radius of the output part 15 of the fly weight 12 is so small that the swing of the fly weight is small dimentionally, and that the lifting angle is stern, therefore, the output part 15 still recieves heavy frictional resistance. Consequently, the problems of the weakness of decompression power, insensitivity in cancelling of the decompression, and the easiness of the defacement at the output part 15 of the fly weight 12 are still remaining.

Moreover, the length along the cam shaft becomes large by the largeness of the space between the cam gear 5 and the cam 3, since the fly weight 12 is located out side of the side surface of the cam gear 5.

Furthermore, the fly weight is easily damaged at the portion where the slit 62 is cut through, decreased the strength by the slit 62.

SUMMARY OF THE INVENTION

Therefore, the first object of the present invention is to make the decompression more powerful, and to improve the sensitivity of the cancelling actuation of the decompression sufficiently.

In order to attain the first object, the system according to the present invention comprises a rim of the cam gear projecting toward the cam to face inner periphery thereof against the outer periphery of the flange; a fly weight inserted between the inner periphery of the rim and the outer periphery of the flange to limit the outward movement of the weight by the inner periphery of the rim, and the inward movement by the outer periphery of the flange; a decompression pin contacted to the output part of the fly weight at the input end thrusting the latter, the input end of the pin being formed in partial spherical surface; and the output part elongated linearly along the length.

The flange arranged on the cam shaft contributes only for recieving the cam gear to fix the position thereof, so that it may be minimized smaller than the boss of the cam gear in diameter. Therefore, the swing of the fly weight may be increased in dimension, and the decompression power which is the product of the weight and the swinging dimension of the fly weight may also be increased. Moreover, the frictional resistance between the contacting surfaces of the decompression pin and the fly weight becomes small for the lifting angle being gentle. Furthermore, the frictional resistance between the output part of the fly weight and the input part of the decompression pin is decreased by finishing them sufficiently accurate in the manner of external grinding or polishing, since the output part of the fly weight is linear and the input part of the decompression pin is partial extruding spherical surface. And the decompression pin may not recieve the resistance produced from the friction with the guide groove 54 which is provided for the first example designated by FIGS. 7 and 8.

Thus, according to the present invention, decompression may be carried more powerfull, then the sensitivity of the cancelling actuation may become sensitive for the increase of the decompression power, and for the outstanding decrease of frictional resistance.

The second object of the present invention is to arrange the system small.

This object may be attained by minimizing the space between the cam gear and the cam in the manner that the fly weight is housed in the internal cavity surrounded by the rim of the cam gear.

The third object of the present invention is to improve the durability against the defacement of the output part of the fly weight and the input end of the decompression pin. This object is attained by the outstanding decrease of the frictional resistance mentioned in the respect of the first object.

The fourth object of the general invention is to eliminate the reduction in the strength of the fly weight.

According to the present invention, since the output part of the fly weight is formed at the inside surface of the free end thereof, the reduction in the strength caused by a slit which contributes as the output part provided in the the first embodiment shown in FIGS. 7 and 8 is eliminated. And since the range of the fly weight's swing is given by the rim of the cam gear and the flange, the reduction in the strength by a slit for the limitation of the range provided in the second embodiment shown in FIGS. 5 and 6 is also eliminated.

The fifth object of the present invention is to eliminate deduction of the decompressing power by the valve spring during the decompression and to realize more sensitive cancelling actuation of the decompression by the biasing power of the valve spring.

In order to attain this object, as seen in FIGS. 3 and 4, the system according to the present invention comprises the following supplementary structure in addition to the structure for attaining the first object mentioned above. When the decompression is carried on, as seen in FIG. 3, the biasing force F of the valve spring acts on the cam face for decompression of the fly weight at right angle by the input part of the decompression pin. The biasing direction of the valve spring is directed to the same direction with the imaginary straight line H, so that the biasing force contributes powerfully to keep decompression state, absorbed by the pivoting pin 34 via fly weight totally.

In the cancelled state, as seen in FIG. 4, the biasing force F acting on the cam face for cancelling at the right is inclined to the imaginary straight line H in $\theta$. So that the vertical component F1 in respect of the imaginary straight line H is absorbed by the pivoting pin 34 via fly weight, and that the horizontal component F2 acts as the thrusting force to move the fly weight toward the cancelling side. Therefore, the fly weight is moved from the decompression position shown in FIG. 3 to the cancelled position shown in FIG. 4 by the centrifugal force and by the horizontal component F2 of the biasing force F at the same time after when the turning speed of the engine has risen to the predetermined speed in the starting operation. As the result, the cancelling actuation of the decompression is carried powerfully and quickly with high sensitivity.

Yet a further object of the present invention is to simplify the structure of the decompression system. To this end, a flange 4 is positioned on the cam shaft 2 for limiting inward movement of the fly weight 12. A cam gear 5 is positioned on the cam shaft for limiting outward movement of the fly weight 12.

Still another object of the present invention is to minimize the distance between the crank shaft and the cam shaft. In the present invention, the cam shaft and crank shaft are provided in parallel. A counter weight 42 is constructed integrally with a crank arm 41, the counter weight having a wall surface 43.

BRIEF DESCRIPTION OF THE DRAWINGS

The invention will be better understood and the objects other than set forth above will become apparent when consideration is given to the following detailed description thereof. Such description makes references with the annexed drawings wherein;

FIG. 1 is a fragmentary vertical sectioned front view of the valve moving system of an over head valve engine according to the first preferred embodiment of the present invention;

FIG. 2 is a section along the line II—II in FIG. 1;

FIG. 3 illustrates the function of the fly weight of the second preferred embodiment of the present invention at the decompression state thereof;

FIG. 4 illustrates the function of the fly weight of the second preferred embodiment of the present invention at the cancelled state of the decompression;

FIG. 5 is a fragmentary front view of a related device;

FIG. 6 is a section along the line VI—VI in FIG. 5;

FIG. 7 is a fragmentary vertical section of the second related device;

FIG. 8 is a section along the line VIII—VIII in FIG. 7.

DETAILED DESCRIPTION OF THE PREFERRED EMBODIMENT

Now, referring to the FIGS. 1 and 2, the explanation of the first embodiment of the present invention will be described hereinafter.

The valve moving system 1 of an over head valve engine has a crank shaft 31 which drives a cam shaft 2 by a crank gear 32 and a cam gear 5 in order to open inlet and outlet valves (not shown) by cams 3 formed around the cam shaft 2, pushing respective tappets 18.

The crank and cam shafts 31, 2 are supported rotatably by respective bearings 33, 36 held in a crank case 30, and tappets 18 are fitted reciprocatable in respective tappet holes 37.

The cams 3 and a flange 4 are formed around the cam shaft 2, and are separated each other by properly designed distances. The cam gear 5 is externally fitted on the cam shaft 2 and located on the position thereof by contacting with the flange 4 at the left side surface thereof, which side is contrary side to the cams 3.

A guide hole 8 is drilled through the shaft part 7 between the nearer cam 3 and the flange 4 transversely with inclination, and a decompression pin 10 is fitted in the hole 8 reciprocatably.

On the other hand, a fly weight 12 is pivoted by a pivot pin 34 on the cam gear 5 at the cam side surface 11, and biased by a spring 14 for decompression disposed at the cam gear side surface 11 toward centripetal direction in the manner of hooking the fly weight at the part 35 for engagement formed at the free end of the weight 12 by the spring 14.

The fly weight 12 is made of two steel plates fixed each other, having an output part 15 formed linear along the length thereof at the inner surface of the free end thereof. The decompression pin 10 has an input end 16 formed in an extruding partial spherical surface at the lower end, and the end 16 is contacted to the output part 15 of the fly weight 12. The input part 16 is extended radially so that the gravitational center C thereof at the retreating would be offset to the retreating side from the axis D of the cam shaft 2.

The output end 17 of the decompression pin 10 formed at the higher end is allowed to contact with one of the tappet 18 so as to perform decompression by thrusting up the decompression pin 10 with the biasing force of the spring 14 transmitted by the fly weight 12.

In this case, the accuracy of the decompression actuation is improved higher by making the reciprocation of the tappet 18 more accurate in the manner of allowing the decompression pin 10 to approach to the center of the tappet 18.

The rim 20 of the cam gear is extruded toward the cams 3, so as to face the inner periphery 21 of the rim 20 against the outer periphery 22 of the flange 4. The fly weight 12 is disposed between the inner periphery 21 of the rim 20 and the outer periphery 22 of the flange 4 in order to limit outward movement of the fly weight 12 by the inner periphery 21 of the rim 20 and inward movement by the outer periphery 22 of the flange 4.

Thus, the automatic decompression system would function as mentioned hereinafter.

In early period of the starting operation of the engine, the fly weight 12 is biased toward centripetal direction by the spring 14 for decompression and received by the outer periphery 22 of the flange 4, pushing the decompression pin 10 forward to keep it at the decompression position. Point A indicates where the output end 17 of the pin 10 is thrusting the tappet 18 up to be effective in the decompression. Then, the necessary power for starting the engine is decreased by the decompression in the combustion chamber.

In last period of the starting operation of the engine, the turning speed of the crank shaft 31 is risen to the predetermined speed, then the turning speed of the cam shaft 2 is risen to give the fly weight sufficiently powerful centrifugal force so as to move it outwardly against the biasing force of the spring 14 until it is received by the inner periphery 21 of the rim 20. The outward movement of the fly weight 12 accompanies the retreat of the decompressing pin 10 to the cancelled position B by the biasing force of the valve spring and the centrifugal force acted on itself, so as to cancel the decompression function and to complete the starting operation of the engine.

After the engine is stopped, the decompression state is revived and kept by the spring 14 forcing the fly weight 12 inward and the decompression pin 10 to the decompression position A.

The dimension of the swing of the fly weight 12 is determined by the radii of the outer periphery 22 of the flange 4 and the inner periphery 21 of the rim 20. The flange 4 is only required to decide the position of the cam gear 5 by recieving it at one side surface, so that the radius of the flange 4 may be smaller than that of the boss of cam gear.

Therefore, the limit of the swing of the fly weight 12 is expanded inwardly by minimized radius of the flange 4, and the frictional resistance between the fly weight 12 and the pin 10 is decreased by the gentle lifting angle of the output part 15 of the fly weight 12.

The decompression pin 10 is forced toward the cancelled position B by the centrifugal force of itself during the running of the engine without contacting with tha tappet 18.

Now, referring to FIGS. 3 and 4, the explanation on the second preferred embodiment of the present invention will be described below.

In this embodiment, the first preferred embodiment shown in FIGS. 1 and 2 is modified in the shape of the output part 15 of the fly weight 12 as followings.

Namely, the output part 15 of the fly weight 12 comprises a cam face **15*a* for decompression which functions to thrust the decompression pin 10 on the decompression position A, and a cam face 15*b* for cancelling the decompression which cam face 15*b* guides the decompression pin 10 toward the cancelled position B, the former being a flat surface which meets at right angles with the imaginary straight line H between the pivoting pin 34 of the fly weight 12 and the input end 16 of the decompression pin 10, and the latter being a inclined flat surface located farther from the axis of the cam shaft 2 (not shown in FIGS. 3 and 4**) than the former.

While there are shown and described preferred embodiments of the present invention, it is not limited thereto, but may be otherwith variously embodied and practiced within the scope of the following claims.

What is claimed is:

1. An automatic decompression system for starting an engine comprising:

a cam shaft;

a crank shaft;

a crank case in which said cam shaft and said crank shaft are disposed;

a flange disposed around said cam shaft;

a cam formed around said cam shaft, apart from and facing a first side of said flange;

a cam gear fitted on said cam shaft so as to contact said flange at a second side opposite said first side;

a guide hole expending transversely through said cam shaft between said cam and said flange;

a decompression pin provided to pass reciprocably through said guide hole;

a fly weight pivotally mounted on a first side of said cam gear facing said cam, said fly weight having an output part for receiving a first end of said decompression pin and a biasing spring means for biasing said decompression pin; and a tappet disposed at a second end of said decompression pin opposite said first end of said decompression pin;

wherein said fly weight is positioned between an inner periphery of a rim of said cam gear and an outer periphery of said flange, outward movement of said fly weight being limited by said inner periphery, and inward movement of said fly weight being limited by said outer periphery of said flange;

whereby said decompression pin is initially biased upwardly, contacting said tappet, and upon starting of the engine, said cam shaft has a turning speed sufficient to produce a centrifugal force in said fly weight greater than said biasing force, so as to move said fly weight outwardly against said biasing force of said biasing spring means until said fly weight is received by said inner periphery of said rim of said cam gear.

2. An automatic decompression system recited in claim 1, wherein said guide hole for said decompression pin is inclined with respect to the cam shaft.

3. An automatic decompression system recited in claim 1;

wherein said first end of said decompression pin is extended radially so as to locate the gravitational center thereof at a point off-set from the axis of said cam shaft to the retreating direction thereof.

4. An automatic decompression system recited in claim 1, wherein said output part of said fly weight comprises a first cam face substantially perpendicular to an axis of said decompression pin for upwardly moving said pin toward said tappet and a second cam face disposed at an acute angle to said decompression pin for cancelling a biasing force of said spring means.

* * * * *